US005282281A

United States Patent [19]

Clear et al.

[11] Patent Number: 5,282,281

[45] Date of Patent: Feb. 1, 1994

[54] PORTABLE VACUUM TOILET SYSTEM

[75] Inventors: Christopher J. Clear, Columbia City; John M. Grooms; Blake V. Ricks, both of Rochester, all of Ind.

[73] Assignee: Burton Mechanical Contractors, Inc., Rochester, Ind.

[21] Appl. No.: 8,190

[22] Filed: Jan. 25, 1993

Related U.S. Application Data

[63] Continuation-in-part of Ser. No. 829,742, Jan. 31, 1992, which is a continuation-in-part of Ser. No. 967,454, Oct. 28, 1992.

[51] Int. Cl.[5] ..... E03D 11/10

[52] U.S. Cl. ..... 4/434; 4/321; 4/323

[58] Field of Search ..... 4/321, 322, 323, 434, 4/435, 436, 437, 438, 439, 440, 441, 442

[56] References Cited

U.S. PATENT DOCUMENTS

| | | | |
|---|---|---|---|
| Re. 28,008 | 5/1974 | Liljendahl | 137/414 |
| 3,663,970 | 5/1972 | Drouhard, Jr. et al. | 4/321 |
| 3,698,019 | 10/1972 | Culp | 4/435 |
| 3,777,778 | 12/1973 | Janu | 4/323 |
| 4,171,853 | 10/1979 | Cleaver et al. | 406/48 |
| 4,199,828 | 4/1980 | Hellers | 4/321 |
| 4,357,719 | 11/1982 | Badger et al. | 4/323 |
| 4,373,838 | 2/1983 | Foreman et al. | 406/14 |
| 4,819,279 | 4/1989 | Sigler et al. | 4/321 |
| 5,078,174 | 1/1992 | Grooms et al. | 137/236.1 |
| 5,232,010 | 8/1993 | Rozenblatt et al. | 4/323 |

FOREIGN PATENT DOCUMENTS

| | | | |
|---|---|---|---|
| 1094255 | 1/1981 | Canada | 4/434 |

*Primary Examiner*—Ernest G. Cusick
*Assistant Examiner*—Charles R. Eloshway
*Attorney, Agent, or Firm*—Jones, Day, Reavis & Pogue

[57] ABSTRACT

A compact, self-contained, portable vacuum toilet system having a sump for collecting waste liquids by means of gravity, a differential pressure-operated discharge valve for regulating withdrawal of waste liquids from the holding sump for transport to a vacuum collection tank during a transport cycle, differential pressure-operated sensor and controller valves for regulating operation of the discharge valve in response to a hydrostatic pressure condition inside the holding sump, and a push button-operated water valve for adding water to the toilet bowl during and immediately after a flush cycle. A sink and its own push button-operated water valve may also be provided.

41 Claims, 12 Drawing Sheets

PORTABLE VACUUM TOILET SYSTEM

CROSS REFERENCE TO RELATED APPLICATION

This is a continuation-in-part of U.S. patent application No. 07/829,742, filed on Jan. 31, 1992 in the names of John M. Grooms and Blake V. Ricks, and U.S. patent application Ser. No. 07/967,454, filed on Oct. 28, 1992 in the names of Christopher J. Clear and John M. Grooms.

BACKGROUND OF THE INVENTION

The present invention relates generally to systems for removing human wastes from a sump associated with a toilet bowl by vacuum pressure and rinsing it thereafter, and more particularly to such a system entailing a differential pressure-operated discharge valve, water valve, and controller valve, as well as a holding sump and vacuum source, which are completely portable.

In a conventional portable toilet system, such as a portable toilet structure commonly known as a PORTA-JOHN®, the toilet seat is mounted directly on top of a holding sump. Human waste drops directly into the sump by means of gravity, where it is collected for subsequent purification and treatment. While such toilet systems are simple in design, and easy to install and operate at construction sites, roadside rest stops, popular outdoor events, etc., they are frequently unsanitary and subject to offensive odors, and usually do not provide a wash sink. For a typical person, they are used as a last resort.

The airplane industry has long felt the need for a more sanitary and appealing toilet system for its aircraft, featuring a conventional toilet bowl and a wash sink. Because of the ready source of vacuum pressure provided by high altitude environments, differential pressure has been used to operate such systems instead of positive pressure provided by a pump. Thus, U.S. Pat. No. 3,922,730 issued to Kemper discloses a recirculating toilet system for use in aircraft or the like. Waste from the toilet bowl is discharged along with a volume of water into a holding sump having a screen positioned therein for separating liquid from the solid elements of the waste stream by means of gravity. While the solid fraction is removed from the sump and therefore the aircraft by means of the differential pressure caused by the reduced pressure condition outside the aircraft, the liquid fraction is chemically treated and then pumped back to the toilet bowl for purposes of rinsing it during a subsequent flush cycle. However, a simple diaphragm actuated flapper is used as a discharge valve, and the control means for regulating the discharge of the contents of the toilet bowl to the holding sump and ejection of rinse water into the toilet bowl are completely electro-mechanical in nature (i.e., a solenoid valve). A vacuum-operated portable toilet system, such as that taught by Kemper, is complicated in design, and its costs are justifiable only in terms of the production and operational costs of the aircraft, itself.

U.S. Pat. No. 4,199,828 issued to Hellers discloses a vacuum toilet apparatus for portable units like trains or buses. Waste in the toilet bowl is discharged under the influence of a vacuum pressure into a material sluice having a simple flap valve at the bottom end thereof. Once a sufficient volume of waste material and liquid is accumulated therein, its weight opens the flap valve and is discharged into a storage tank by means of gravity for subsequent treatment. The vacuum pressure is provided by compressed air passing through a pneumatic ejector. Liquid from a container is discharged into the toilet bowl to rinse it. However, not only does the Hellers system require a source of compressed air to operate the pneumatic ejector, but also the volume of vacuum pressure created thereby is typically small. Moreover, electronic control means are required to operate the system.

U.S. Pat. No. 3,995,328 issued to Carolan et al. discloses the vacuum toilet system that is currently used on Boeing-built aircraft. Although once again the differential pressure between the aircraft cabin pressure and ambient conditions at high altitudes is used while the plane is in flight, a vacuum pressure transducer operated by means of pumps provides a vacuum pressure source, while the aircraft is on the ground to draw material from the toilet bowl and wash basin into the holding sump. A filter in the holding sump is used to recover sufficient liquid from the waste matter so that the liquid may be recycled as the flushing fluid for rinsing the toilet bowl. But the design of the flush and rinse valves are not disclosed, and the control means for the system is primarily electronic.

SUMMARY OF THE INVENTION

Accordingly, it is an object of the present invention to provide a vacuum toilet system for evacuating waste liquids from the sump associated with a conventional toilet bowl or wash basin to a collection vessel by means of vacuum pressure for subsequent treatment.

Another object of the present invention is to provide such an apparatus, which is easily portable, and may be conveniently taken to popular outdoor events like country fairs, concerts, etc.

Yet another object of the present invention is to provide such an apparatus having a discharge valve and controller valve, which are completely operated by means of differential pressure.

Still another object of the present invention is to provide such an apparatus having a self-contained source of vacuum pressure.

Yet another object of the present invention is to provide such an apparatus, which is compact enough to fit into a small privacy shelter along within a wash basin, and has a minimum number of mechanical parts subject to breakage.

These and other objects may be more easily understood by resort to the description of the invention contained herein in conjunction with the accompanying drawings.

Briefly, the invention is directed to a compact, self-contained, portable vacuum toilet system having a sump for collecting waste liquids by means of gravity, a differential pressure-operated discharge valve for regulating withdrawal of waste liquids from the holding sump for transport to a vacuum collection tank during a transport cycle, differential pressure-operated sensor and controller valves for regulating the operation of the discharge valve in response to a hydrostatic pressure condition inside the holding sump, and a push button-operated water valve for adding water to the toilet bowl during and immediately after a flush cycle. A sink having its own push button-operated water valve may also be provided.

DETAILED DESCRIPTION OF THE PREFERRED EMBODIMENT

Figure 1:
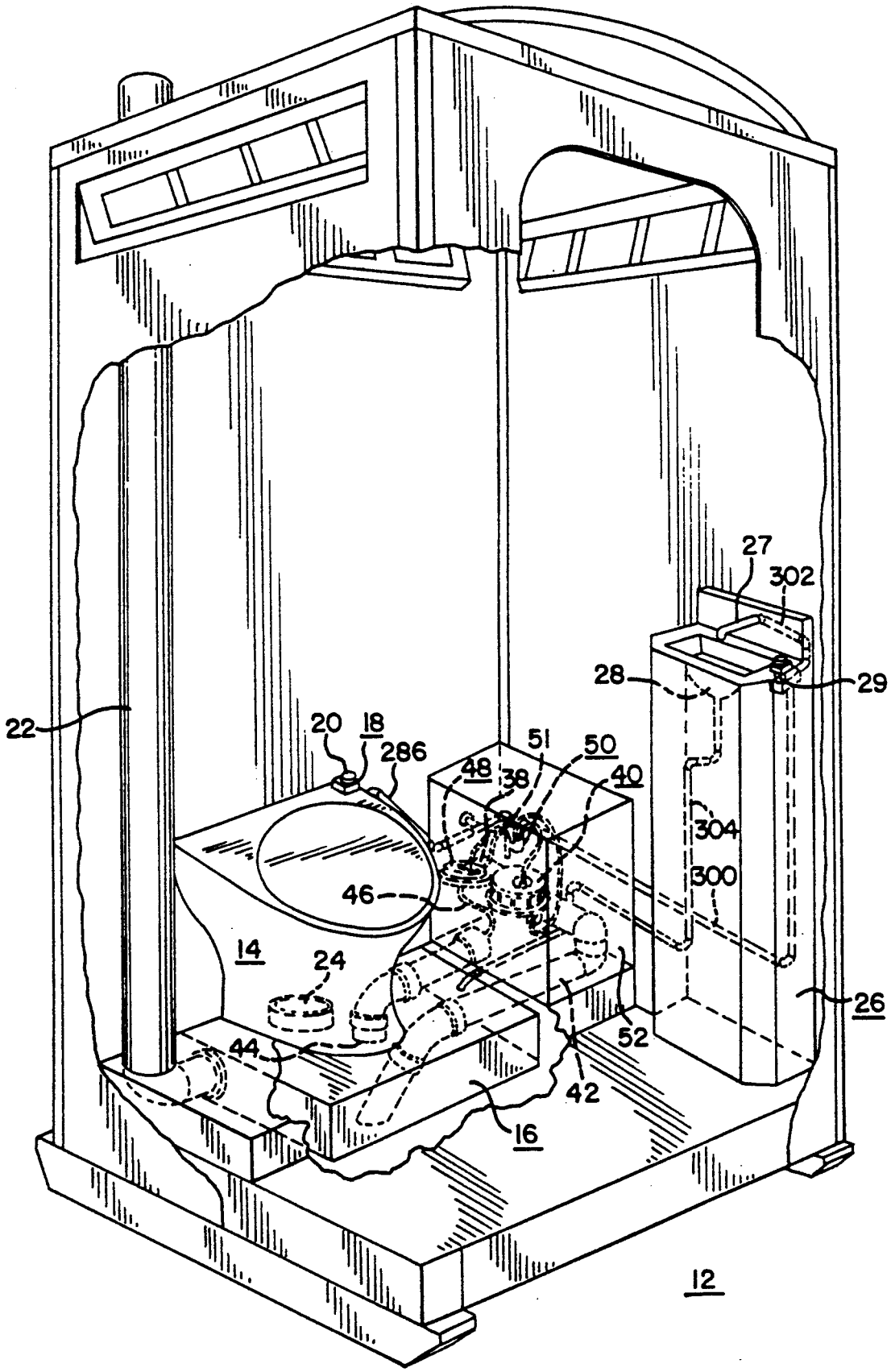
FIG. 1 shows a partially cutaway view of a portable lavatory of the present invention.
Figure 2:
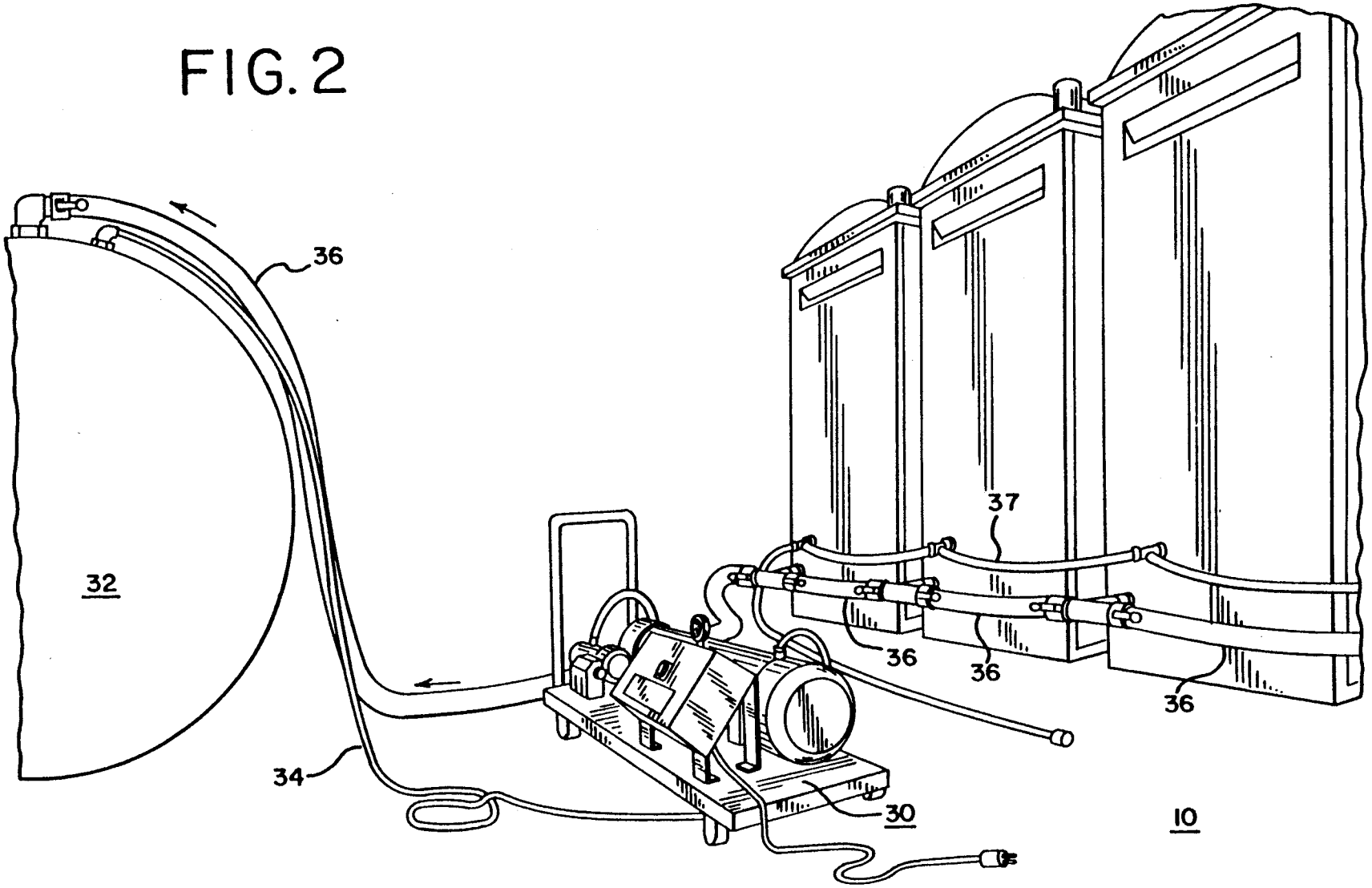
FIG. 2 shows the collection tank and vacuum and water supplies associated with the portable lavatory shown in FIG. 1.

The portable vacuum toilet system 10 of the present invention is shown in FIGS. 1 and 2. Although multiple lavatory housings 12 are shown, it should be understood that individual lavatories could be rigged in the same manner in a trailer, train, airplane, open field, etc.

Referring to FIG. 1, which shows a partially cutaway view of such a housing 12. A conventional low-flush toilet 14 having, for example, a 0.8 liter flush volume, is mounted onto a holding sump 16 having a volume sufficiently large to accumulate the volume discharged by the toilet during a number of flush cycles. In the preferred embodiment, holding sump 16 contains at least 40 liters.

A manually activated water valve 18 with a flush push button 20 is mounted to the cabinetry of toilet 12 such that when the push button is depressed, a predetermined volume of water is discharged into the toilet bowl in a conventional manner (e.g., through a spray ring positioned around the upper internal perimeter of the bowl) to commence a flush cycle. A spring loaded flap valve 2 positioned along the bottom of the bowl opens upon accumulation of a predetermined volume (and weight) of water and waste liquid in the bowl during the flush cycle to discharge the contents to the holding sump 16 by means of gravity. Thus, water from water valve 18 not only increases the volume in toilet bowl 12 to open flap valve 24, but also it rinses and fills the bowl with a predetermined volume of clean water after the flap valve closes once again due to the spring force to terminate the flush cycle.

Vacuum pump 30 provides a ready source of vacuum or subatmospheric pressure to collection tank 32 by means of hose 34. At the same time, collection hose 36 connects collection tank 32 to conduit 38, which, in turn, is connected to discharge valve 40, which is positioned inside housing 12. The upstream end of discharge valve 40 is connected to suction pipe 42, whose open end is positioned inside holding sump 16.

As the volume of waste material accumulates inside holding sump 16, the hydrostatic pressure therein will likewise increase. Sensor pipe 44 communicates the hydrostatic pressure level via hose 46 to sensor valve 48. The sensor valve, in turn, is operatively connected to controller valve 50 by means of hose 51, the controller valve being connected to the upper housing of discharge valve 40 for regulating the operation thereof.

When controller valve 50 opens discharge valve 40 to commence a transport cycle, the vacuum or subatmospheric pressure condition in conduit 38 causes the accumulated waste inside holding sump 16 to be withdrawn by means of differential pressure, whereupon it passes through the open discharge valve 40 and into collection hose 36 for transport to vacuum collection tank 32 for subsequent treatment. Vent pipe 22 is connected to sump 16, thereby providing a ready source of atmospheric pressure thereto so that introduction of a vacuum or subatmospheric pressure condition to the holding sump during a transport cycle will not collapse the wall of the holding sump, nor will it draw flap valve 24 to the open position. Once controller valve 50 closes discharge valve 40 to terminate the transport cycle, however, a vacuum/subatmospheric pressure condition is returned to conduit 38 and collection hose 36, and waste liquid is added to holding sump 16 during subsequent flush cycles. Cabinet 52 may be used to conceal sensor value 48, controller valve 50, discharge valve 40, sensor pipe 44, sensor pipe 42, and conduit 38, as well as associated hoses, while providing ready access thereto for purposes of maintenance and repair.

Figure 3:
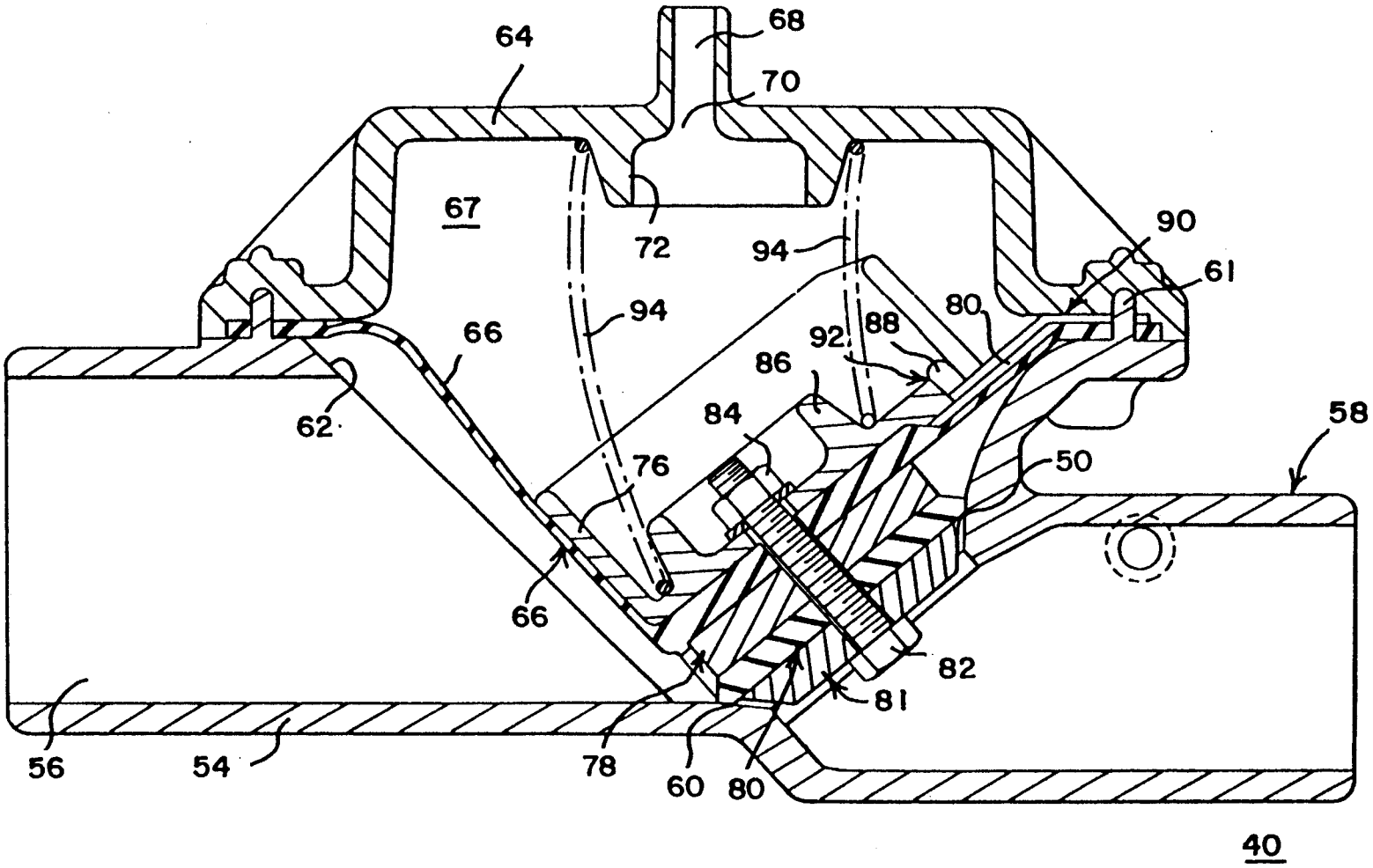
FIG. 3 shows a sectional view of the discharge valve in the closed, standby position.

FIG. 3 illustrates discharge valve 40 in its standby, closed position. It may comprise an offset flow conduit 54 having an inlet portion 56 and an outlet portion 58, the longitudinal axis of each being nonconcentric. In such a case, the diameter of inlet portion 56 preferably is larger than outlet portion 58 in order to accommodate larger flows of waste liquid through the valve, and eliminate sharp corners in the pipe. Valve stop 60 is situated along flow conduit 54 between the inlet and outlet portions of the conduit.

An opening 62 is formed in the top portion of flow conduit 54. Secured thereto by suitable means is bonnet 64. Although nuts and bolts are shown in the embodiment of FIG. 3, it should be understood that alternate means, such as a "twist on" locking mechanism could also be used. The conduit and bonnet portions of the discharge valves must handle harsh environments in normal applications, so they should be made from suitable materials like ABS, polyethylene, polypropylene, or PVC.

The edges of flexible diaphragm 66 are secured between bonnet 64 and flow conduit 54 so that a pressure-tight chamber 67 is defined by the diaphragm and bonnet. Spigot 68 extends from a point on the exterior surface of bonnet 64, and defines inlet 70 in the top of the bonnet. Depending from the interior surface of the top of bonnet 64 is ring wall 72 in nonconcentric relation with the diameter of bonnet 64, the purpose of which will become apparent shortly.

A portion of diaphragm 66 is sandwiched between piston cup 76 and seat spacer 78. Valve seat 80 is positioned adjacent to seat spacer 78, and seat retainer 81, in turn, is positioned adjacent to the other side of the valve seat. The shank of bolt 82 passes through the seat retainer, valve seat, seat spacer, diaphragm, and piston cup, whereupon a nut 84 is threaded to secure all of these parts in tight engagement.

A ring wall 86 extends from the interior surface of piston cup 76 and around nut 84. Ring wall 86 is not concentric with respect to the diameter of piston cup 76. Flange 88 on flex strip 90 is lodged in aperture 92 in the bottom of piston cup 76, the other end of the flex strip being secured between the locating pin 61 and bonnet 64. Spring 94 is positioned inside the valve chamber 67 formed by bonnet 64 and diaphragm 66, one end being held by ring wall 72 and the other end secured by ring wall 86.

The geometry of valve stop 60 is such that the side edges of seat retainer 81 mate precisely therewith. Valve seat 80 is made from a rubber-like compound like EPDM, and extends beyond the edges of seat spacer 78 and seat retainer 81 so that it is pressed against valve stop 60 when discharge valve 40 is in the closed position to prevent migration of waste material through the valve stop, and provide a pressure-tight seal so that vacuum or subatmospheric pressure may be established in the conduit 38 and collection hose 36 immediately downstream of the discharge valve. Moreover, the nonconcentric geometries of ring wall 72 on bonnet 64 and ring wall 86 in piston cup 76 are such that spring 94 pivots valve seat 80 against valve stop 60 in an arc defined by the length of flex strip 90. The pivotable valve seat and plunger allow use of a smaller valve housing 67 than is possible with prior art vacuum valves having piston shafts.

Diaphragm 66 should be made from a flexible, but resilient rubber-like material, such as EPDM, to allow the necessary degree of movement during repeated reciprocation of discharge valve 40 between the open and closed positions. Flex strip 90 should be made from a flexible plastic acetyl material like DELRIN® sold by DuPont to permit flexibility without undue stretching over time.

It should be understood that other discharge valve designs will function equally well in the portable vacuum toilet system of the present invention. One such design is disclosed in U.S. Pat. No. 5,082,238 issued to the assignee of the present application, and the teachings thereof are incorporated herein by reference in full.

Figure 5:
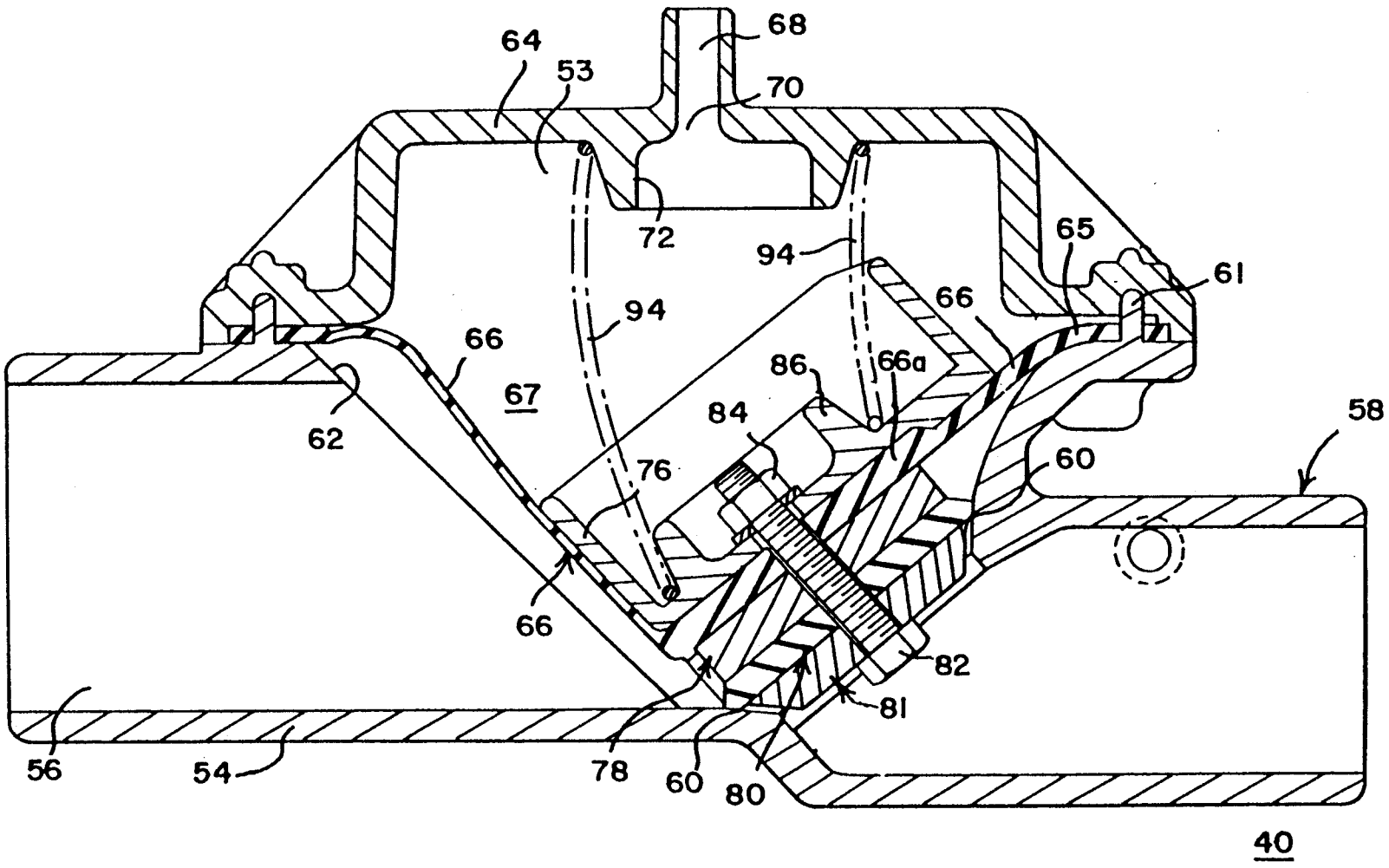
FIG. 5 shows a sectional view of another embodiment of the discharge valve in the closed, standby position.
Figure 6:
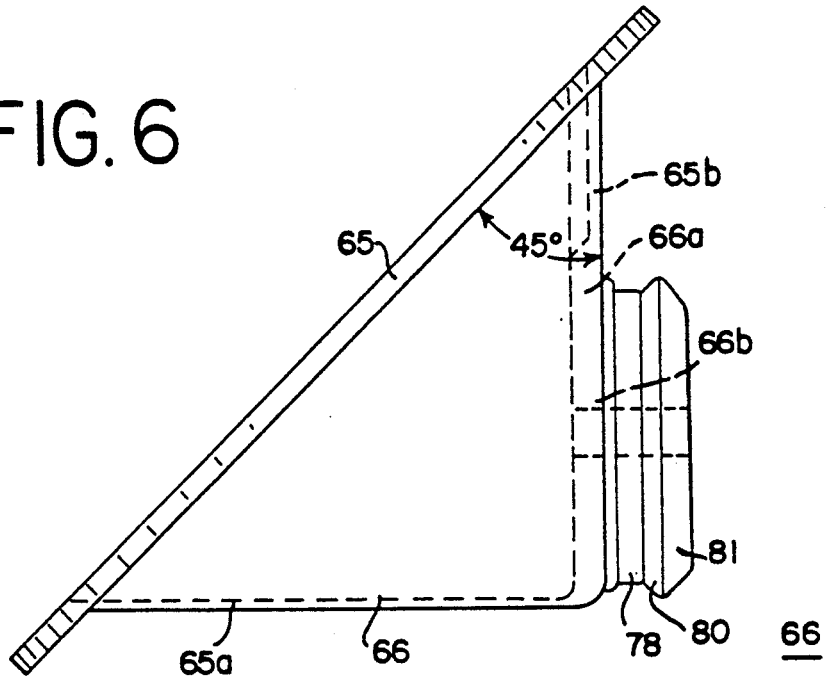
FIG. 6 shows a side view of the diaphragm and valve seat portions of the discharge valve shown in FIG. 5.
Figure 7:
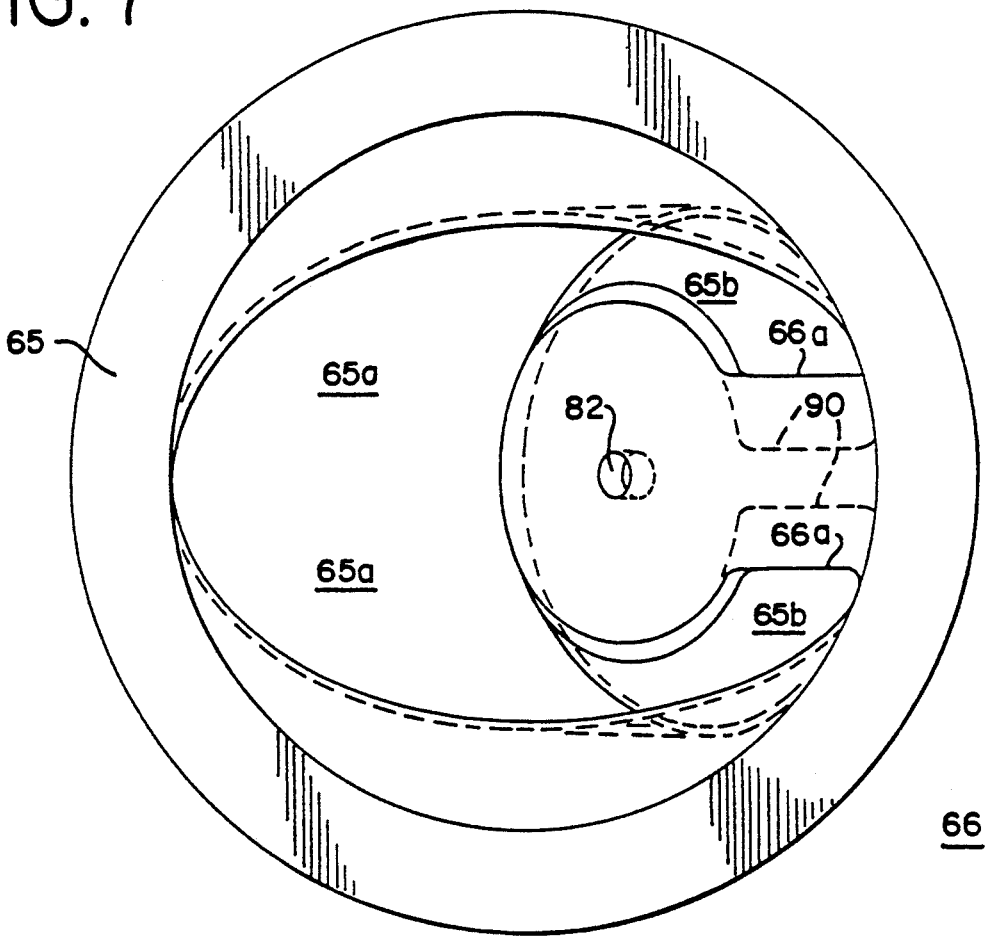
FIG. 7 shows a plan view of the diaphragm and valve seat of the discharge valve shown in FIG. 6.

Another alternate embodiment of discharge valve 40 is shown in FIG. 5. Like parts have been marked with like numbers for identification purposes. Instead of flex strip 90, diaphragm 66 has a reinforced flex area **66*a* along the one side, as more clearly shown in FIGS. 6–7. Diaphragm 66 depends from in cross-sectional view (see FIG. 6), which meet collar portion 65 at approximately a 45° angle when extended during discharge valve closure. A vertical portion of side 65*b* is thickened to define flex area 66*a*. For a 1½-inch diameter valve stop 60, flex area 66*a* should be approximately ⅔ the size of the valve aperture, and 2 to 3 times the thickness of the rest of the diaphragm wall. Because this reinforced flex area will not stretch as much as the rest of diaphragm wall during valve operation, it can control the arc of movement of the valve seat during reciprocal operation. It has been found that this reinforced flex area 66*a* is more durable than plastic flex strip 90** during repeated valve operation.

Figure 8:
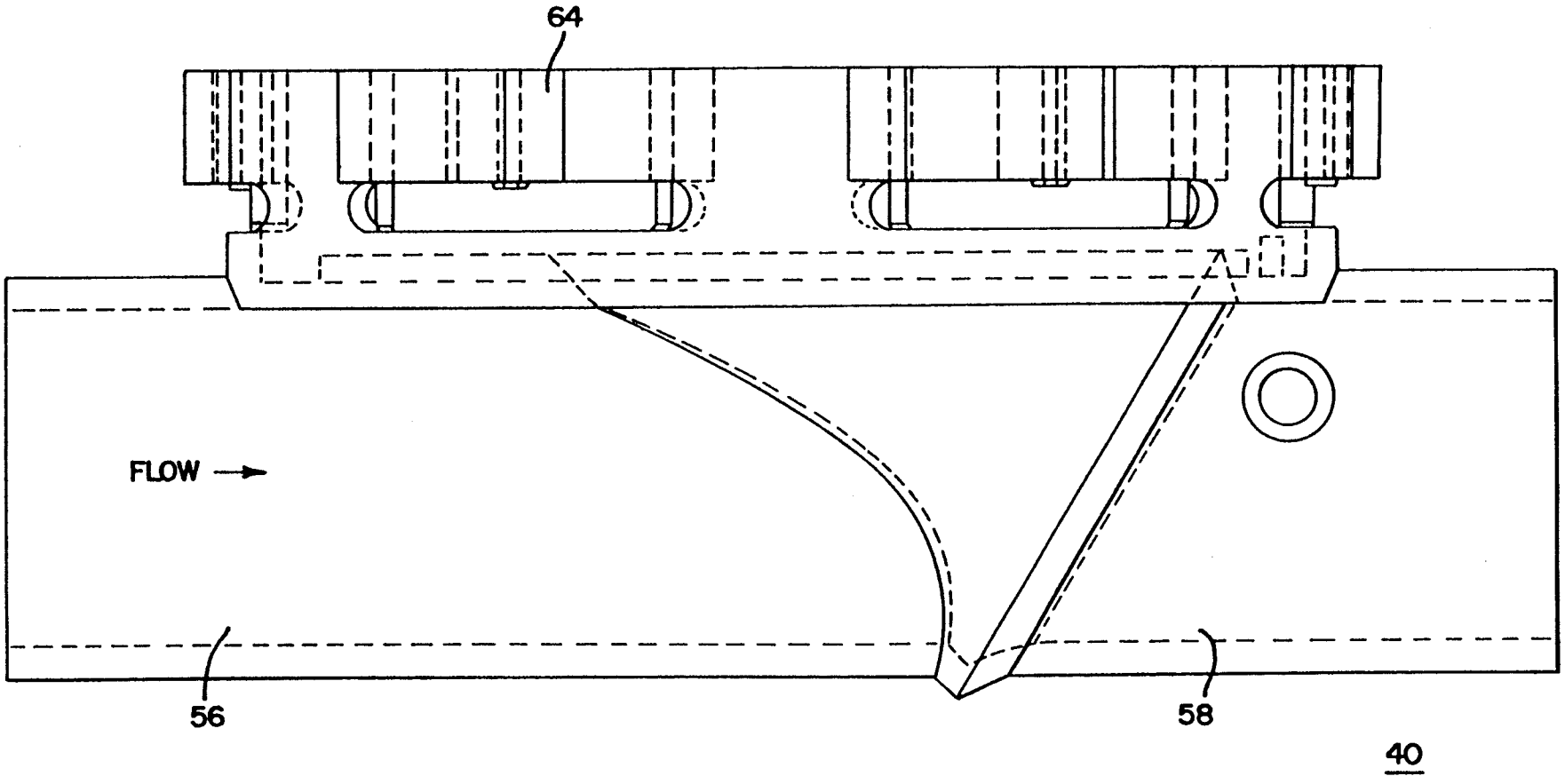
FIG. 8 shows a side view of another embodiment of the discharge valve.

The discharge valve of FIG. 5 could also have concentric inlet and outlet pipes 56 and 58 to provide a "straight through" flow path. It has also been found that these pipes can be made of the same diameter, while accommodating waste material flows. Such a valve is shown in FIG. 8, which also exemplifies the twist-on bonnet discussed previously.

Figure 4:
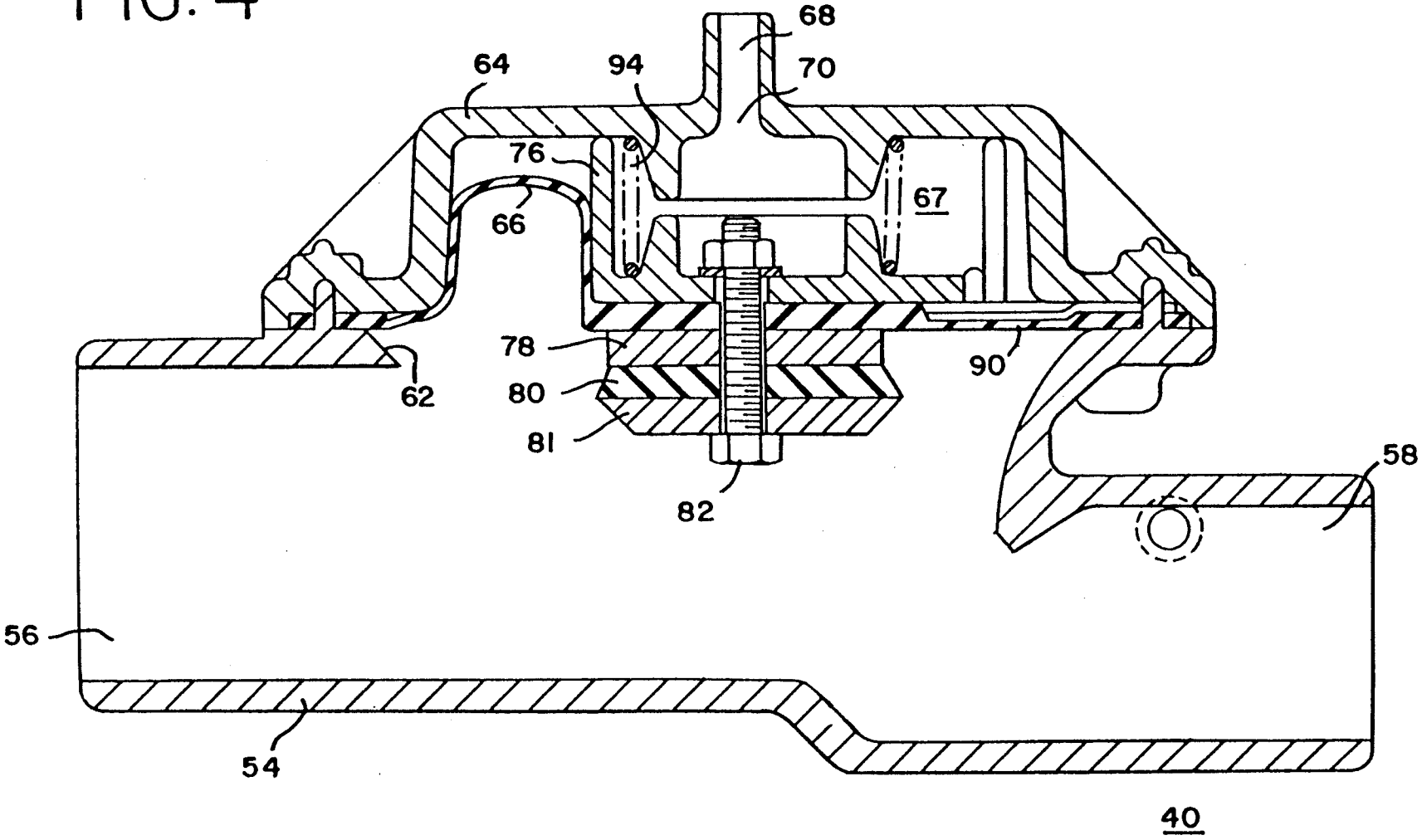
FIG. 4 shows a sectional view of the discharge valve of FIG. 3 in the open position.

Atmospheric pressure is maintained in valve chamber 67 when discharge valve 40 is in the closed position, as depicted in FIG. 3. When vacuum/subatmospheric pressure is communicated, however, to valve chamber 67 by controller valve 50, a differential pressure is applied across diaphragm 66, thereby overcoming the force applied by spring 94. This causes the diaphragm to move to the actuated position shown in FIG. 4, thereby opening discharge valve 40 so that waste liquid in holding sump 16 may flow into conduit 38 and collection hose 36, and ultimately into vacuum collection tank 32. When atmospheric pressure is returned to valve chamber 67, however, the process is reversed, and discharge valve 40 is returned to the closed position shown in FIG. 3.

Sensor valve 48 and controller valve 50 may be used to regulate the passage of vacuum/subatmospheric pressure to valve chamber 67 of discharge valve 40 in response to the hydrostatic pressure level inside holding sump 16. Hose 46 provides an operative means of pressure communication between holding sump 16 and sensor valve 48 in order deliver the hydrostatic pressure level contained in the sump to the sensor valve.

Figure 9:
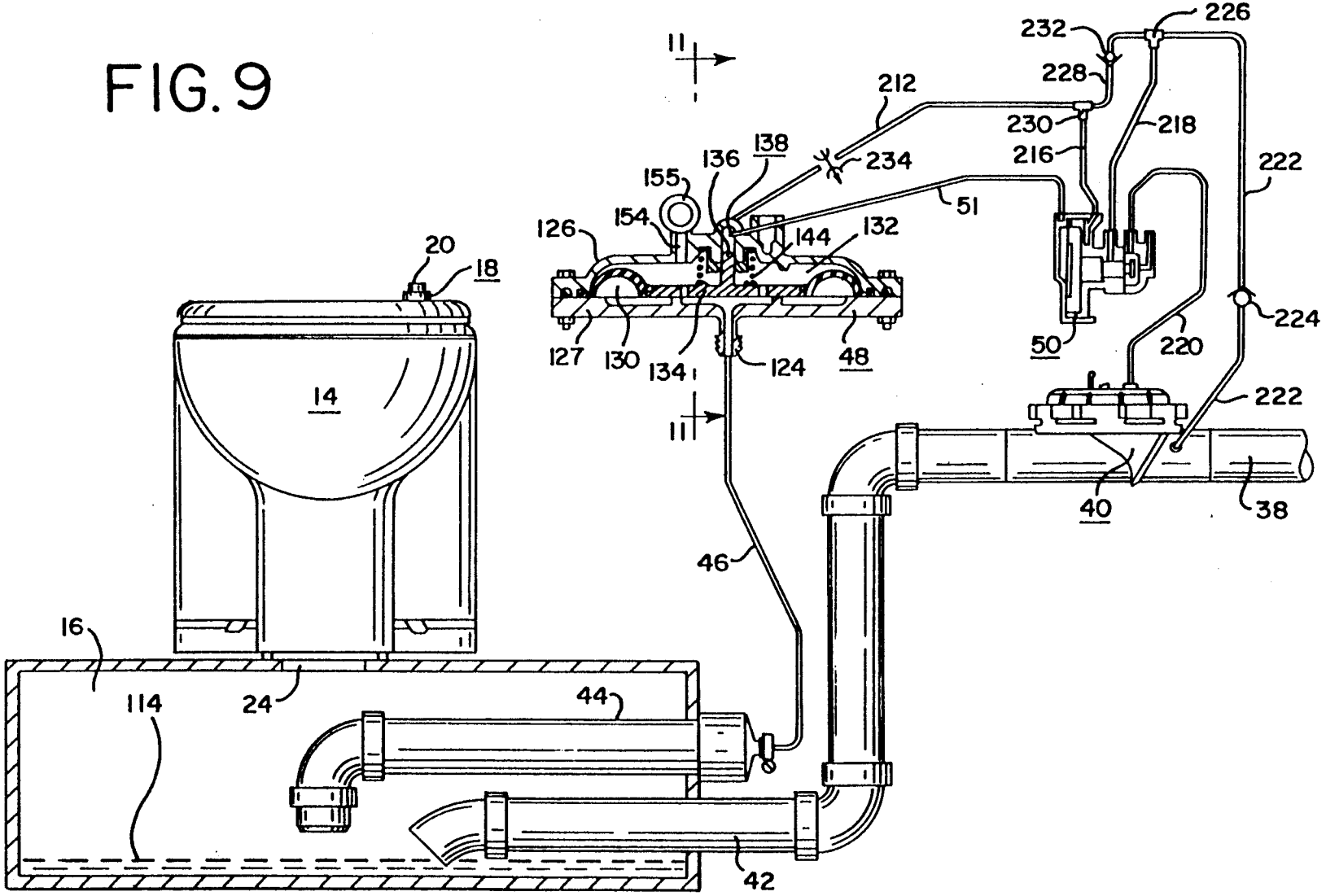
FIG. 9 shows an enlarged view of components and pneumatic circuitry of the present invention, including a sectional side view of the sump and sensor valve with the sensor valve shown in the closed standby position.
Figure 10:
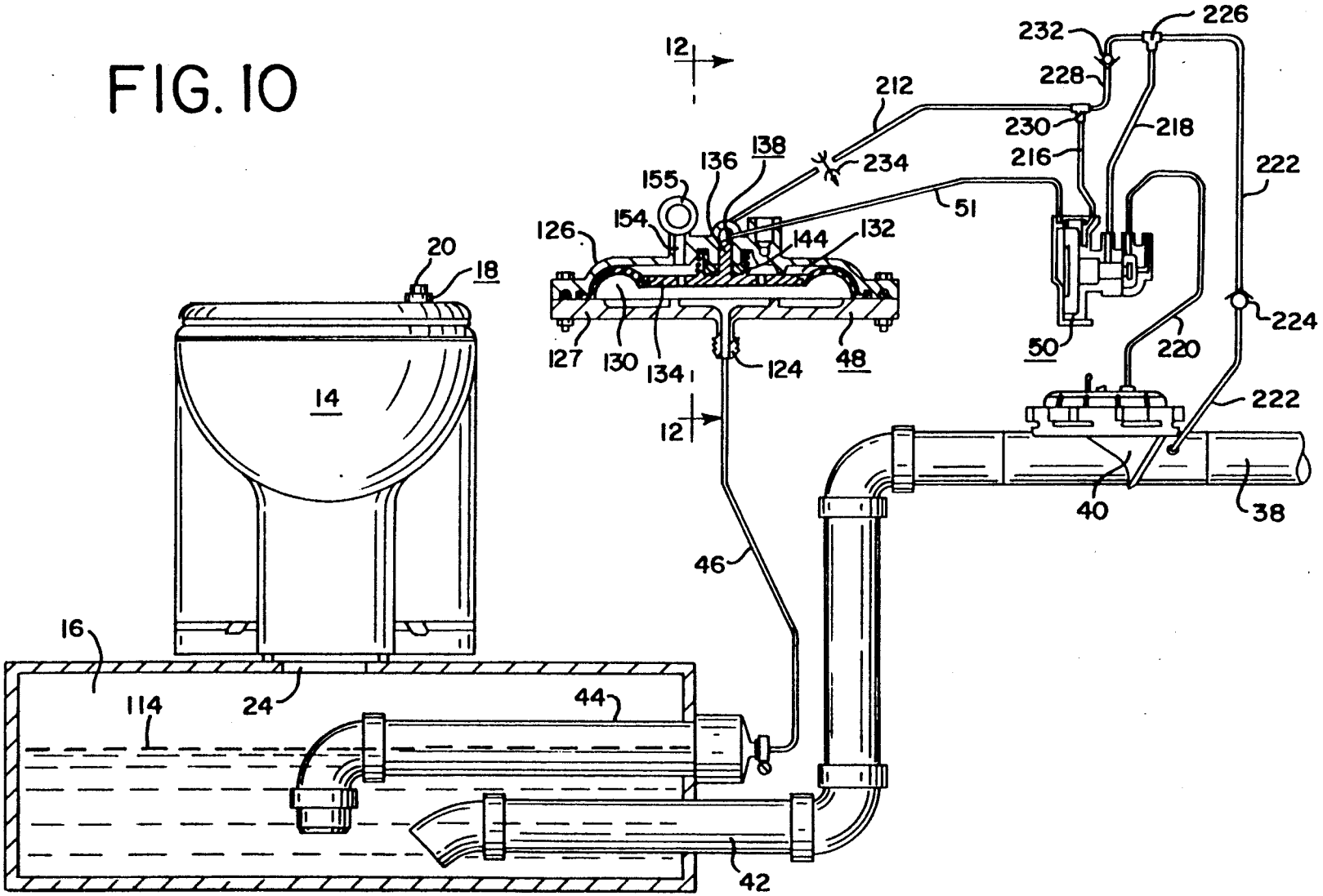
FIG. 10 shows the components and pneumatic circuitry of FIG. 8 with the sensor valve shown in the open position.

Key components of vacuum toilet system 10 are shown more clearly in FIGS. 9 and 10, including sump 16 and sensor valve 48 in cross-sectional view. Waste liquid 114 enters the sump through flap valve 24, as previously discussed, and accumulates therein. As it accumulates, it produces increasing hydrostatic pressure therein, which is communicated through the sensor pipe 44 (which is interjected through the side surface wall of sump 16) and hose 46.

Figure 11:
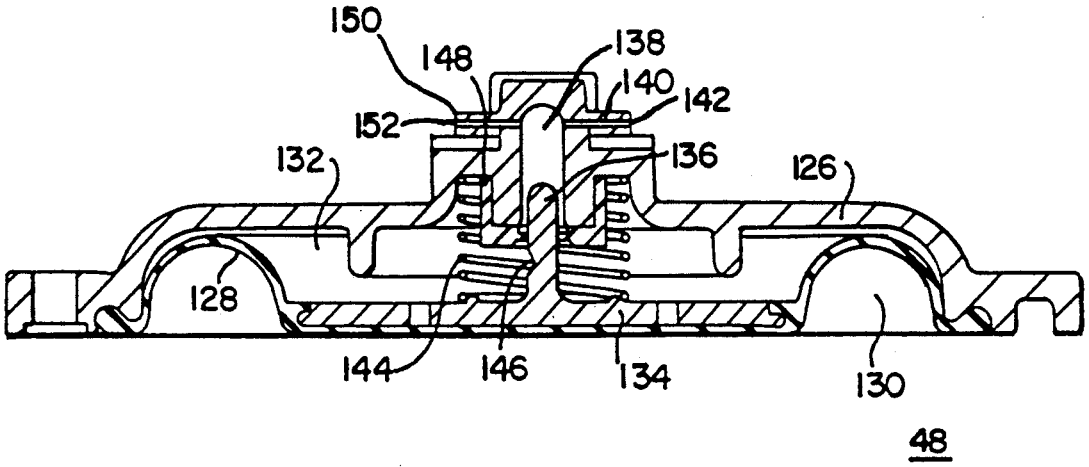
FIG. 11 shows a sectional view of the sensor valve of FIG. 9 taken along line 11—11.

Connected to hose 46 by means of nozzle 124 is sensor valve 48. The sensor valve includes a solid body 126 and bottom plate 127 made of suitable material, such as plastic, which are combined to provide a liquid and air-tight seal therebetween. Trapped between the bottom surface of sensor valve body 126 and bottom plate 127 is a pliable diaphragm 128 made from a rubber-like material like EPDM, Which serves to divide sensor valve 48 into chambers 130 and 132, respectively. Mounted on the inside surface of diaphragm 128 is pressure plate 134 from which extends plunger post 136. Plunger post 136 reciprocates inside channel 138 of sensor valve body 126. Channel 138 terminates in a nozzle 140 (see FIGS. 11 and 12) positioned on top of sensor valve body 126, which has an air passage 142 through it.

Vent 154 communicates atmospheric pressure to chamber 132 at all times. Filter 155 is positioned over the opening of vent 154 to prevent particulate matter in the atmosphere from entering sensor valve 48. Moreover, vacuum/subatmospheric pressure is communicated to channel 138 by hose 210, nozzle 150, and air passage 152.

A spring 144 is positioned between sensor valve body 126 and diaphragm pressure plate 134 to bias diaphragm 128, and therefore plunger post 136, away from channel 138. An undercut region 146 (see FIGS. 11 and 12) in plunger post 136 permits passage of air through a portion thereof. Normally, this undercut region 146 is positioned below rubber seal 148 mounted on sensor valve body 126 adjacent to plunger post 136 so that atmospheric pressure may not be communicated from chamber 132, through plunger post 136 to channel 138, and through nozzle 140 into the inlet port of controller valve 50 (see FIGS. 9 and 11). In this case, the standard vacuum/subatmospheric pressure condition existing in channel 138 is communicated directly to controller valve 50.

Figure 12:
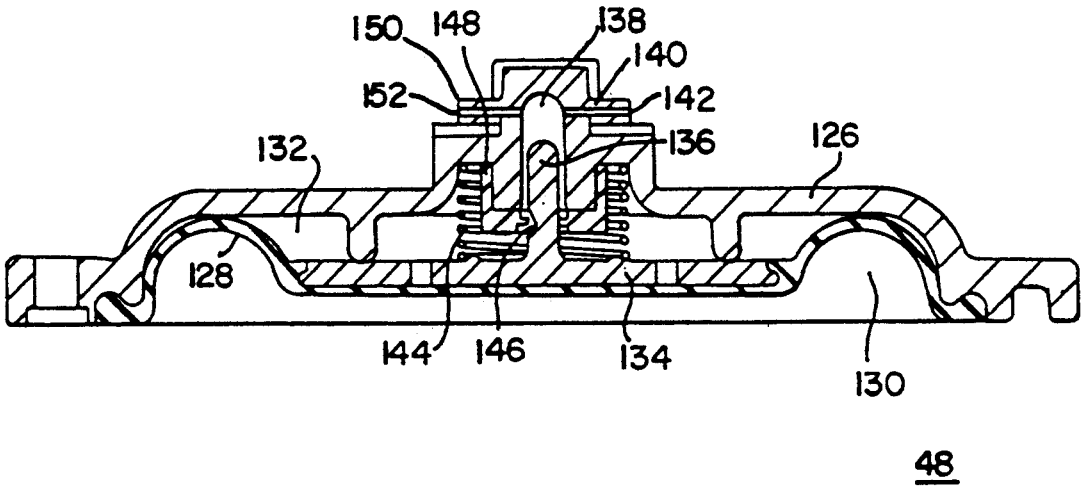
FIG. 12 shows a sectional view of the sensor valve of FIG. 10 taken along line 12—12.

However, when the accumulating waste liquid 114 creates a sufficient level of hydrostatic pressure in chamber 130 exerted against diaphragm 128, plunger post 136 is biased into channel 138 so that the undercut region bypasses rubber seal 138 (see FIGS. 10 and 12). At this point, atmospheric pressure is communicated from chamber 132 to channel 138 and therefore through nozzle 140 to hose 51 connected to controller valve 50. Once the level of hydrostatic pressure drops sufficiently upon discharge of sump 16, the process is reversed, and atmospheric pressure is no longer communicated by sensor valve 48 to controller valve 50. Instead, vacuum/subatmospheric pressure is once again communicated through air passage 152 and nozzle 150 to channel 138, and thereby through nozzle 140 to the inlet port of controller valve 50.

Figure 13:
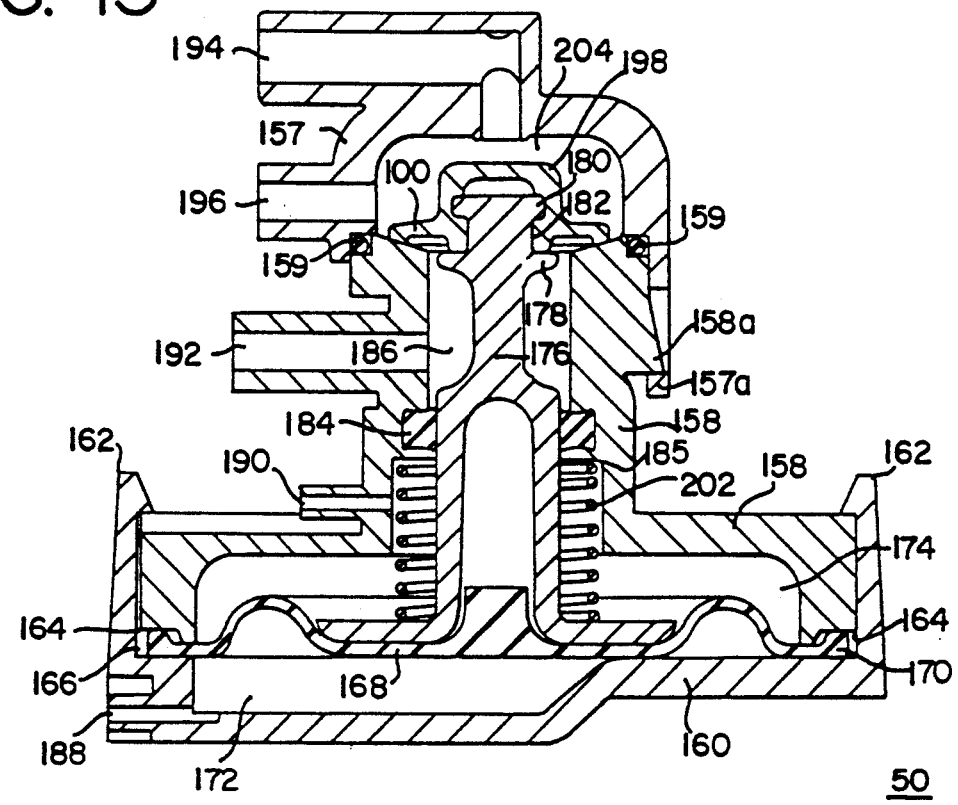
FIG. 13 shows a sectional side view of the controller valve shown in the closed, standby position.
Figure 14:
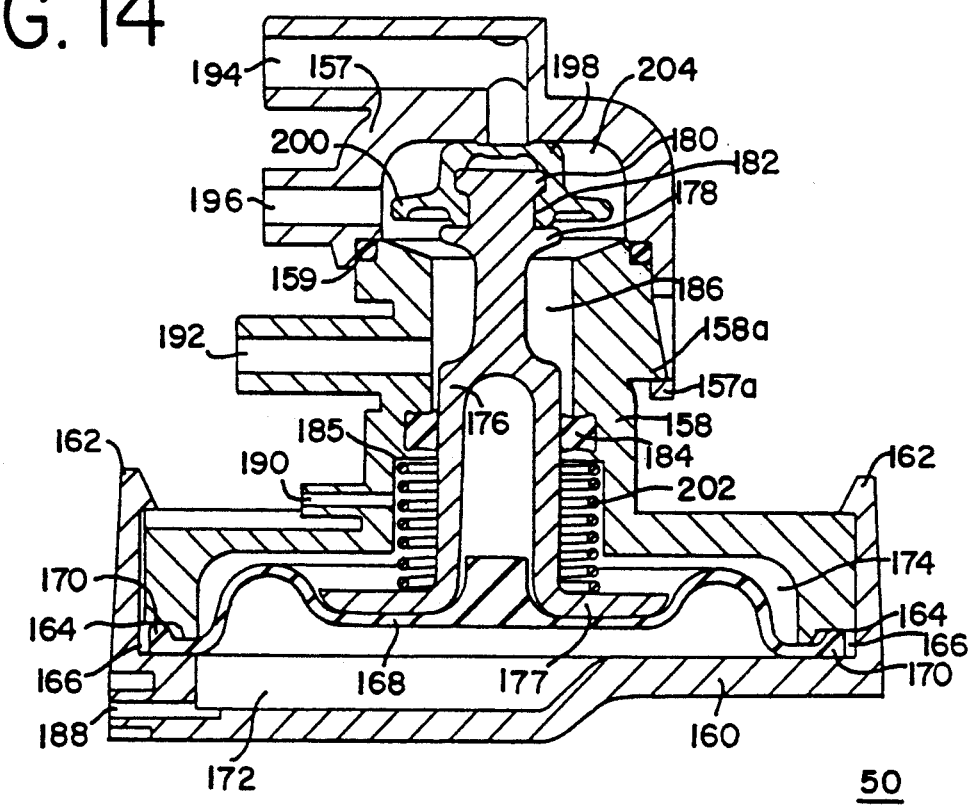
FIG. 14 shows a sectional side view of the controller valve of FIG. 13 shown in the open position.

Controller valve 50 is illustrated in Figs. 13 and 14. It comprises an upper housing 157, a middle housing 158, and a lower housing 160. Upper housing 157 is connected to middle housing 158 by means of a snap fit flanges 157*a* and 158*a*, respectively, and the walls of lower housing 160 terminate in flanges 162, which snap fit around the base portion of middle housing 158 to create the controller housing. Rubber O-ring 159 is positioned between the upper and middle housings to provide an air and liquid-tight seal. The bottom surface of middle housing 158 features stepped lip 164, which cooperates with the inner surface of lower housing 160 to create annular niche 166. Positioned between the mating middle and lower housings 158 and 160, respectively, is a flexible diaphragm 168 made of a rubber-like material like EPDM, which includes a lip 170 along its peripheral edge to engage annular niche 166 in a locking position. Diaphragm 168 serves to divide the controller housing into a first chamber 172 and a chamber 174, and to ensure an air and liquid-tight seal between the two housings.

Seated against diaphragm 168 and extending into middle and upper housings 158 and 157, respectively, is plunger 176, which has lips 178 and 180 extending laterally near its distal end, which cooperate to form annular niche 182. Contained between the lateral edge of plunger 176 and a step located midway along the inside surface of middle housing 158 is rubber seal 184. This seal serves two functions: it divides the middle housing into second chamber 174 and vacuum chamber 186, and it provides an air and liquid-tight seal between these two chambers.

Located near the bottom of lower housing 160 is inlet port 188 to which is connected hose 51, and which serves to communicate the pressure condition delivered by channel 138 of sensor valve 48 into first chamber 172. First vacuum inlet port 190, in turn, delivers vacuum pressure into second chamber 174 at all times by means of hose 216. Middle housing 158 also includes a second vacuum inlet port 192 connected to hose 218, while upper housing 157 includes an atmospheric air inlet port 194 located along its top side. At a lower position on upper housing 157 is outlet pressure port 196.

A U-shaped cap 198 made from a rubber-like material like EPDM engages annular niche 182 of plunger 176 to surround its distal end. The cap includes flange 200 radiating laterally from its lower edge. Spring 202 is positioned between lip 177 of plunger 176 and washer 185 to bias plunger 176, and therefore cap 198, away from atmospheric air port 194.

When vacuum or subatmospheric pressure is delivered by sensor valve 48 to first chamber 172 of controller valve 50 through hose 51 and inlet port 188, equal pressure is applied across both sides of diaphragm 168, and spring 202 biases plunger 176 and cap 198 away from engagement with atmospheric air port 194, thereby causing flange 200 to engage the inner wall of middle housing 158. In so doing, vacuum or subatmospheric pressure from vacuum chamber 186 is shut off, and atmospheric pressure is delivered instead to control chamber 204 and therefore to outlet port 196 (see FIG. 13) for communication through hose 220 to valve chamber 67 of discharge valve 40 to close it. On the other hand, if atmospheric pressure is delivered to first chamber 172 by sensor valve 48, the resulting differential pressure applied across diaphragm 168 overcomes the force of spring 202, thereby causing plunger cap 198 to abut atmospheric air port 194 and open instead a passage from vacuum chamber 186 to control chamber 204 (see FIG. 14). Now vacuum or subatmospheric pressure is communicated through outlet port 196 and hose 220 to discharge valve 40 to open it.

It is also possible to use a single integrated sensor-controller valve in the present invention instead of a separate sensor valve 48 and controller valve 50, as previously discussed U.S. Pat. No. 4,373,838 issued to Foreman et al., and owned by the assignee of the present invention, discloses one such sensor-controller valve design, which communicates vacuum/subatmospheric pressure to valve chamber 47 of discharge valve 40 in response to the hydrostatic pressure level in holding sump 16.

Hose 222 serves to deliver vacuum or subatmospheric pressure to the control circuitry of vacuum toilet system 10. One end is connected to conduit 38 immediately upstream of discharge valve 40, which will generally be maintained at a vacuum/subatmospheric pressure condition by vacuum collection tank 32. Interposed within hose 222 is check valve 224, which serves to prevent waste liquid residing in conduit 38 from entering controller valve 50 or sensor valve 48. The other end of hose 222 is connected to T-junction 226 to which is also connected hose 218 and hose 228. Hose 228, in turn, is connected to T-junction 230, which is also joined to hoses 216 and 212. A second check valve 232 is interposed within hose 228 as a precautionary measure.

Therefore, a reliable source of vacuum or subatmospheric pressure is communicated by hose 222 to T-junction 226, hose 228, and T-junction 230. From here, it may readily be supplied to inlet ports 192 and 190 of controller valve 50 by means of hoses 218 and 216, respectively. It may likewise be communicated to inlet nozzle 150 of sensor valve 48 by means of hose 212. Because the components of vacuum toilet system 10 are unlikely to become submerged under water, atmospheric air is provided to the control circuitry by means of inlet ports 154 and 194 of sensor valve 48 and controller valve 50, respectively.

Interposed within hose 212 is needle valve 234. As previously described, the pneumatic circuitry process will be reversed to terminate the transport cycle when the hydrostatic pressure condition communicated to chamber 130 of sensor valve 48 is reduced to the point that spring 144 returns plunger post 136 to its standby position so that channel 138 is no longer in the position necessary to communicate the atmospheric pressure condition of chamber 132 to channel 138. Immediately after the return of plunger port 136 to its standby position, however, channel 138 will still be at atmospheric pressure, while it is gradually returned to a vacuum/-subatmospheric pressure condition by hose 212 and inlet nozzle 150. Needle valve 234 therefore serves to restrict the passage of vacuum/atmospheric pressure through 212 to delay the amount of time needed to replace the atmospheric pressure condition in channel 138. This delay will ensure that discharge valve 40 remains open a predetermined amount of time during a transport cycle after holding sump 16 is emptied and the resulting hydrostatic pressure condition reaches zero in order to allow a predetermined amount of atmospheric pressure in holding sump 16 (communicated therein by atmospheric vent 22) also to pass through the opened discharge valve 40 and enter conduit 38 to provide the necessary differential pressure across the waste liquid to sweep it there through to collection tank 32 Needle valve 234 is variably adjustable to allow the delay period likewise to be adjusted.

Figure 16:
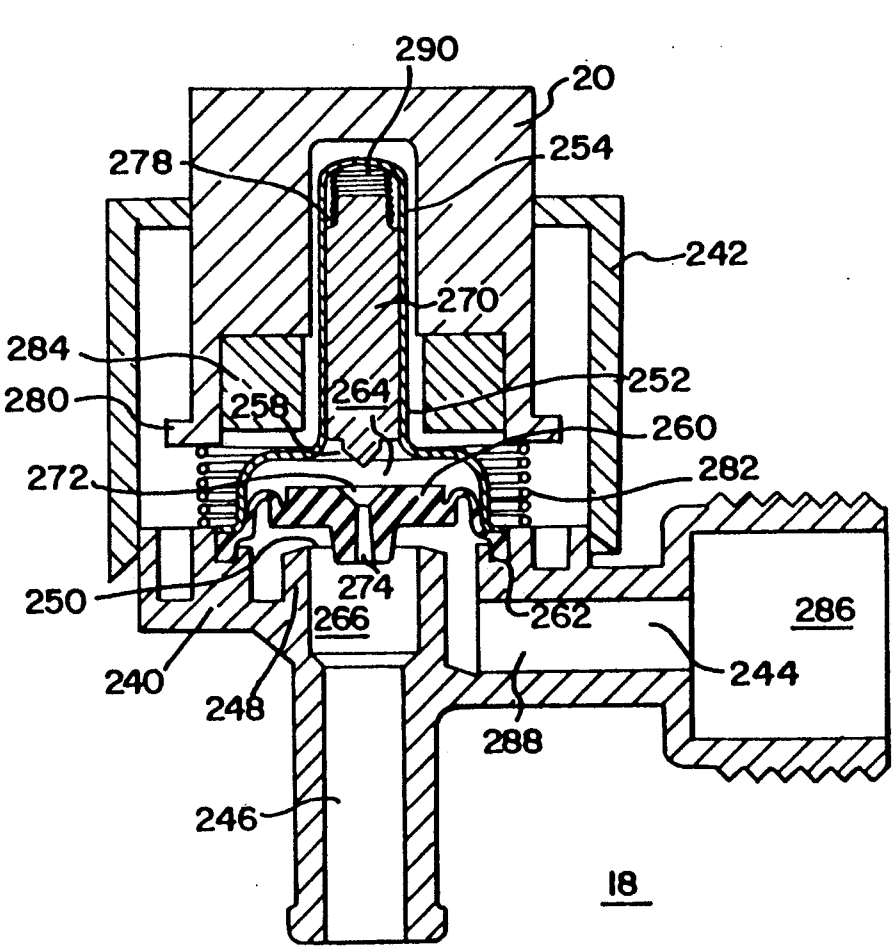
FIG. 16 shows a sectional side view of the water valve of FIG. 15 shown n the open position.
Figure 15:
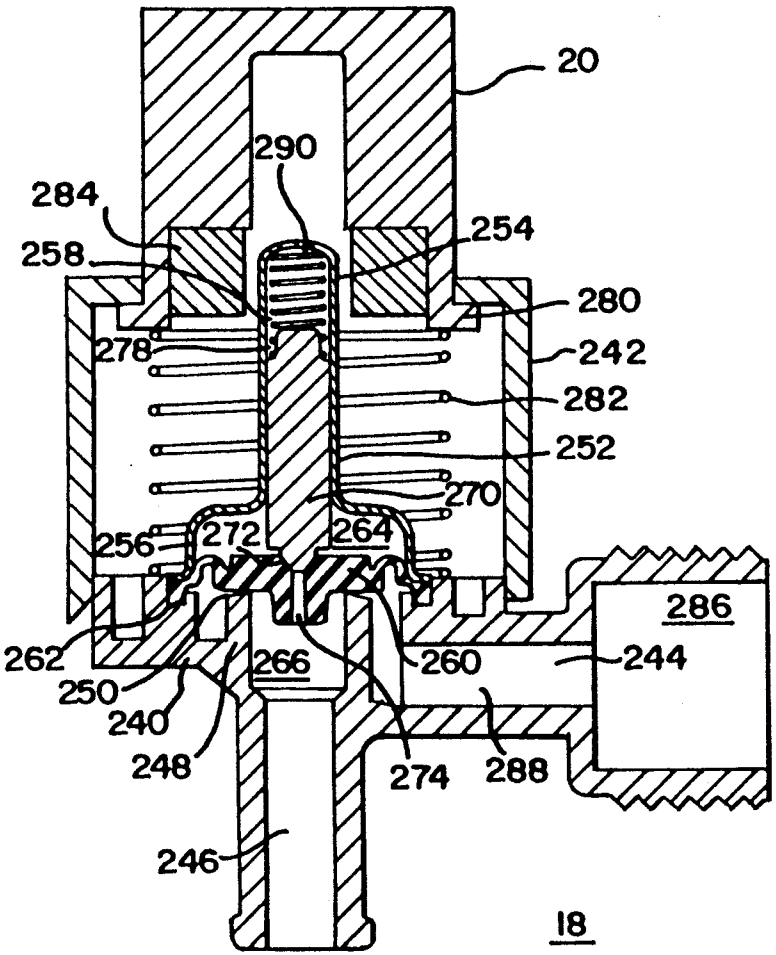
FIG. 15 shows a sectional side view of the water valve shown in the closed, standby position.

The push button water valve 18 used to permit addition of a predetermined volume of rinse water to toilet bowl 14 to commence a flush cycle is shown in Figs. 15 and 16. It comprises a lower housing 240 to which is snap-fitted an upper housing 242. Located along lower housing 240 are water inlet port 244 and water outlet port 246. The upper surface of ring wall 248 located adjacent to outlet port 246 defines valve stop 250.

Sheath 252 features a long protrusion 254 and a bell shaped base 256 and is structually rigid. Protrusion 254 defines piston channel 258. The perimeter of a flexible diaphragm 260 made from a rubber-like material, such as EPDM, is secured in annular niche 262 located in lower housing 240 by means of the bottom surface of sheath 252. Diaphragm 260 serves to define an upper chamber 264 located within the bell-shaped portion of sheath 252, and a lower chamber 266 located within the lower housing 240 and operatively in communication with water outlet port 246.

An armature 270 is positioned within piston channel 258. Its lower end terminates in tapered region prong 272, which fits into a conical shaped chamber 274 in the center of diaphragm 260 to block passageway 276 depending from chamber 274. The upper end 278 of armature 270 is chamfered. A spring 280 fits around the chamfered end position 278 of armature 270, and bears against the interior top surface of sheath 252 to bias tapered region 272 of armature 270 into chamber 272 to close water passageway 274.

Meanwhile, push button 20 extends through a hole in the top surface of upper housing 242, with flange 280 to prevent the push button from becoming separated from upper housing 242. Spring 282 is positioned around sheath 252, and between flange 280 and ring wall 248 to bias push button 20 away from the upper housing 242 to the standby position shown in FIG. 15. An annularly-shaped magnet 284 is secured to the lower interior end of push button 20, and likewise fits around sheath 252.

Water is delivered to inlet port 244 by means of pipe 286, which, in turn, is connected to water supply hose 37 (see FIG. 2). Referring to FIG. 15 where water valve is shown in the standby position, a small hole (not shown) in diaphragm 260 permits water to gradually seep from channel 288 into upper chamber 264. This creates equal fluidic pressure across both sides of the diaphragm.

When push button 20 is depressed to the position shown in FIG. 16, however, magnet 284 will move armature 270, by means of repulsive force, to the upper end of piston channel 258. Now tapered region 272 of armature 270 is removed from conical chamber 274, and the water in upper chamber 264 can freely pass through passageway 274 to enter lower chamber 266. The resulting unequal pressure across diaphragm 260 caused by the reduction in water pressure within upper chamber 264 causes diaphragm 260 to move away from valve stop 250 to open water valve 18. Now water in channel 288 can pass directly to lower chamber 266, through outlet port 246, and into toilet bowl 14.

Once pressure is released from push button 20, however, spring 282 returns it to the standby position shown in FIG. 15. Now, the repulsive force of magnet 284, along with the biasing force of spring 290, pushes armature down within piston channel 258 s that tapered region 272 closes passageway 276. Water pressure will gradually build up once again in upper chamber 264 to the point that equalized pressure across diaphragm 260 moves the diaphragm once again against valve stop 250 to close the water valve.

While an electro-magnetic solonoid water valve manufactured by the Dole Water Valve Company of Morton Grove, Ill., and sold by Eaton Corporation, forms the basis for the water valve 18 of the present invention, the electro-magnetic coil of the Dole valve has been removed, and replaced with the spring-biased, push button and magnet assembly to produce a mechanical valve having a magnet. This allows water valve 18 to be used in conjunction with portable vacuum toilet system 10 in the field where an electrical hookup often is unavailable.

A delay feature can be incorporated into water valve 18 to ensure that enough water is delivered to toilet bowl 14 to open valve flap 24 to commence the flush cycle, and to fill the toilet bowl after valve flap 24 is closed. This can be accomplished by dimensioning the hole (not shown) in diaphragm 260 small enough that it extends the time required to fill upper chamber 264 with water after passageway 274 is closed by tapered region 272 of armature 270, taking into account the time needed to pass the volume of liquid in the toilet bowl 14 into holding sump 16, and to refill the toilet bowl with water.

Also located in housing 12 (see FIG. 1) is a sink 26. A water valve 29 identical to water valve 18 receives water from hose 300, and communicates water to faucet 27 by means of hose 302 in response to activation of the push button control. The gray water passes through drain 28 and into hose 304 whereupon it is conveyed to sump 16 for discharge during a subsequent transport cycle, as previously described.

While particular embodiments of the invention have been shown and described, it should be understood that the invention is not limited thereto, since many modifications may be made. The invention is therefore contemplated to cover by the present application any and all such modifications which fall within the true spirit and scope of the basic underlying principles disclosed and claimed herein.

What is claimed is:

1. A self-contained lavatory facility for accumulating and storing waste liquids for subsequent treatment, comprising:

(a) a portable shelter structure, containing:

(i) a source of waste liquids;

(ii) a holding sump connected to the waste liquid source for accumulating a predetermined volume of waste liquids;

(iii) a differential pressure-operated sensor means operatively in communication with said holding sump for establishing communication of a vacuum or subatmospheric pressure condition, or an atmospheric pressure condition as an output pressure condition, said sensor means having a first inactivated condition, and a second activated condition arising when the predetermined waste liquid volume is accumulated within said holding sump, whereby vacuum or subatmospheric pressure is delivered while said sensor means is in one condition, and whereby atmospheric pressure is delivered while said sensor means is in another condition;

(iv) a differential pressure-operated controller means operatively in communication with the output pressure condition delivered by said sensor means for establishing communication of one of those pressure conditions as an output pressure condition, said controller means having a first condition and a second condition, whereby vacuum or subatmospheric pressure is delivered while said controller means is in one condition, and whereby atmospheric pressure is delivered while said controller means is in another condition;

(v) a differential pressure-operated injection means operatively in communication with the output pressure condition delivered by said controller means, said injection means having an open condition to permit passage of waste liquids from said holding sump to a vacuum transport hose and thereby commence a waste liquid transport cycle therein, said injection means also having a closed condition to block passage of waste liquids therethrough and thereby terminate the transport cycle, whereby said injection means converts between the open and closed conditions based upon the pressure condition delivered by said controller means;

(b) a portable collection vessel connected to the vacuum transport hose being maintained at a vacuum or subatmospheric pressure condition, said collection vessel receiving the waste liquids during a transport cycle, and storing them for subsequent treatment, said collection vessel also operatively communicating vacuum or subatmospheric pressure to said vacuum transport hose;

(c) a source of atmospheric pressure; and (d) a portable source of vacuum or subatmospheric pressure operatively in communication with said collection vessel.

2. A portable lavatory facility as recited in claim 1, wherein said sensor means comprises a 2-way, 2-position spool valve.

3. A portable lavatory facility as recited in claim 2, wherein said spool valve is actuated by the hydrostatic pressure arising from the accumulated waste liquids in said holding sump.

4. A portable lavatory facility as recited in claim 3, wherein said spool valve, comprises:

a. a housing;

b. a pliable diaphragm connected to said housing in an air-tight manner to divide said housing into a first chamber and a second chamber;

c. an inlet means in a wall of said housing for admitting hydrostatic pressure from said holding sump into the first chamber to bear against said diaphragm;

d. an aperture in a wall of said housing having an annular wall depending therefrom into the second chamber to form a channel, said channel communicating externally by means of a nozzle connected to said housing over said aperture;

e. a plunger shaft contained within the second chamber and having a first end and a second end, said first end being seated against said diaphragm, said second end reciprocating inside the channel, sealing means being positioned between said plunger shaft and the annular wall to provide an air-tight seal;

f. spring means positioned between said diaphragm and said housing to bias said diaphragm away from the channel; and g. an undercut passage located in a portion of one side of said plunger shaft, whereby said undercut passage generally is positioned completely within the second chamber to prevent a pressure condition existing in the second chamber from being communicated to the channel to replace the standby pressure condition communicated directly to the channel by a hose connected to a pressure source, and whereby when the hydrostatic pressure exerted on said diaphragm overcomes the force exerted by the spring, said plunger shaft is reciprocated inside the channel so that the undercut passage therein interconnects the second chamber to the channel to communicate a pressure condition existing in the second chamber to the channel.

5. A portable lavatory facility as recited in claim 2, further comprising timing means for adjusting the duration of the transport cycle.

6. A portable lavatory facility as recited in claim 5, wherein said timing means comprises means for adjusting the size of the bore of a hose communicating a standby pressure condition to said sensor means to return it to the inactivated condition.

7. A portable lavatory facility as recited in claim 6, wherein said adjustment means comprises a needle valve having a restricted passage.

8. A portable lavatory facility as recited in wherein said controller means comprises a 3-way, 2-position spool valve.

9. A portable lavatory facility as recited in claim 8, wherein said spool valve comprises:

a. a housing;

b. a pliable diaphragm connected to said housing in an air-tight manner to divide said housing into a first chamber and a second chamber;

c. first inlet means in a wall of said housing to admit the output pressure condition communicated by said sensor means into the first chamber;

d. a plunger shaft having a first end and a second end, the first end seated against said diaphragm, the second end having secured thereto a flanged cap made of a resilient material, sealing means positioned along the interior of the housing wall interacting with said plunger shaft to separate a third chamber from said second chamber;

e. an outlet chamber positioned within said housing in operative communication with the third chamber;

f. second inlet means positioned in a wall of said housing for admitting vacuum or subatmospheric pressure to the second chamber;

g. third inlet means positioned in a wall of said housing for admitting vacuum or subatmospheric pressure to the third chamber;

h. fourth inlet means positioned in a wall of said housing for admitting atmospheric pressure to the outlet chamber;

i. outlet means positioned in the housing wall for venting the pressure condition contained in the outlet chamber; and j. spring means positioned between said diaphragm and the wall of the second chamber, whereby the flanged cap secured to said plunger shaft generally closes pressure communication between the third chamber and the outlet chamber so atmospheric pressure is delivered through the outlet means to said injection means, and whereby differential pressure exerted against said diaphragm causes the flanged cap to close the fourth inlet means so vacuum or subatmospheric pressure is delivered instead through the outlet means.

10. A portable lavatory facility as recited in claim 1, wherein said sensor means and said controller means are combined in a single differential pressure-operated control valve for automatically controlling the operation of the injection means in response to the hydrostatic pressure condition arising from the accumulated waste liquids in said holding sump, said control valve having a pressure sensor means operatively in communication with the hydrostatic pressure level for establishing communication of one of these pressure conditions to said injection means when the predetermined volume of waste liquids is accumulated in said holding sump to open said injection means to commence a transport cycle by means of sequentially activated differential pressure responsive control elements disposed between said pressure sensor means and said injection means, and to close said injection means to terminate the transport cycle by sequentially reversing activation of the differential pressure responsive control elements in response to the volume of waste liquids accumulated in said holding sump falling below the predetermined level.

11. A portable lavatory facility as recited in claim 10, further comprising means for regulating the operation of said sequentially activated differential pressure means of said control valve to return said injection means from the open position to the closed position.

12. A portable lavatory facility as recited in claim 11, wherein said regulating means comprises a needle valve with a restricted passage disposed in a conduit between said pressure source and said sequentially activated differential pressure means.

13. A portable lavatory facility as recited in claim 12, wherein said restricted passage of said needle valve is adjustable.

14. A portable lavatory facility as recited in claim 1, wherein said injection means comprises a vacuum discharge valve, having an open position and a closed position.

15. A portable lavatory facility as recited in claim 14, wherein said discharge valve comprises:

(a) a valve body having an entry opening and an exit opening;

(b) a valve stop in the valve body disposed to separate the openings when said discharge valve is in the closed position;

(c) a valve plunger disposed for reciprocating movement in said valve body relative to said valve stop to alternately open and close said discharge valve, said plunger having a first end and a second end opposite said first end, said plunger having seating means connected to said first end of the plunger matable with said valve stop to provide liquid and air-tight closure of said discharge valve; and (d) control means connected to said plunger for selectively opening and closing said discharge valve in response to the pressure condition communicated by said control valve.

16. A portable lavatory facility as recited in claim 15, wherein said valve plunger is progressively and sharply reduced in diameter from the first end thereof to the second end thereof to facilitate opening the discharge valve and eliminate jamming the discharge valve caused by lodgement of foreign objects between said plunger and said valve body.

17. A portable lavatory facility as recited in claim 15, wherein said seating means on the first end of said plunger comprises an assembly of co-axially disposed seating elements arranged to provide a generally annular beveled seating means, which will eliminate the collection of foreign objects between said elements and ensure valve closure.

18. A portable lavatory facility as recited in claim 15, wherein said control means comprises a co-axially disposed shaft connected at its first end to said plunger and at its second end to a piston operator.

19. A portable lavatory facility as recited in claim 18, wherein shaft sealing means are provided relative to said plunger to preclude fluid leakage along the shaft when said discharge valve is closed.

20. A portable lavatory facility as recited in claim 18, wherein bearing means are provided between said valve plunger and said piston operator for orienting said shaft and said plunger carried thereby in a predetermined angular relationship with said valve seat to assure valve closure during repetitive operation of said discharge valve.

21. A portable lavatory facility as recited in claim 18, wherein sliding liquid-tight shaft sealing means are disposed adjacent to said bearing means, said shaft sealing means being adapted to prevent the migration of fluid and fluid-borne contaminants along said shaft and into said piston operator.

22. A portable lavatory facility as recited in claim 15, wherein said control means comprises a reinforced area on said diaphragm, and wherein said piston operator is fixed in a nonconcentric relation with said valve housing whereby said plunger moves in an arc when reciprocated between the open position and the closed position to allow a smaller valve housing, said reinforced area on said diaphragm defining the arc of movement of said plunger.

23. A portable lavatory facility as recited in claim 22, wherein said piston operator comprises a piston cup having a ring wall connected thereto, a spring disposed between said piston cup ring wall and a ring wall connected to the upper interior surface of said valve housing, said ring walls being in a nonconcentric relation when said plunger is disposed to the closed position.

24. A portable lavatory facility as recited in claim 15, wherein said entry opening of said valve body is of a different diameter than said exit opening.

25. A portable lavatory facility as recited in claim 24, wherein said entry opening is larger than said exit opening.

26. A portable lavatory facility as recited in claim 15, wherein said control means comprises a flexible strip connected at its first end to said plunger and at its second end to said valve body, said flexible strip also being connected to a piston operator.

27. A portable lavatory facility as recited in claim 26, wherein said piston operator is fixed in a nonconcentric relation with said valve housing whereby said plunger moves in an arc defined by said flexible strip when reciprocated between the open position and the closed position to allow a smaller valve housing.

28. A portable lavatory facility as recited in claim 26, wherein said piston operator comprises cup having a ring wall connected thereto, a spring disposed between said piston cup ring wall and a ring wall connected to the upper interior surface of said valve housing, said ring walls being in a nonconcentric relation when said plunger is disposed to the closed position.

29. A portable lavatory facility as recited in claim 26, wherein sealing means are provided relative to said plunger to prevent fluid leakage into said piston operator when said discharge valve is closed.

30. A portable lavatory facility as recited in claim 1, wherein said waste liquid source comprises a toilet bowl operatively connected to said holding sump by means of barrier means.

31. A portable lavatory facility as recited in claim 30, wherein said barrier means comprises a spring-biased flap valve.

32. A portable lavatory facility as recited in claim 31, further comprising a water valve for conveying a predetermined volume of water to the toilet bowl in response to an input condition, the water serving to apply the necessary force to open said spring-biased flap valve, and to rinse the 33. A portable lavatory facility as recited in claim 32, wherein said input condition comprises a manually activated push button.

34. A portable lavatory as recited in claim 33, wherein said water valve comprises:

(a) a housing having a water inlet port and a water outlet port;

(b) a valve stop located adjacent to the water outlet port;

(c) a bell-shaped sheath positioned within said housing to define a piston channel and a valve chamber;

(d) a flexible diaphragm extending across a portion of said housing to separate the valve chamber from the water outlet port, the perimeter of said diaphragm being secured between said housing wall and said sheath wall;

(e) an armature located within said piston channel, having a chamfered region at one end, and a tapered region at the other end, a spring within said piston channel and secured to the chamfered region biasing the tapered region of said armature against a passageway in said diaphragm to close it when said water valve is in the inactivated condition;

(f) a push button biased in extending relation from the top surface of said housing by a spring, said push button surrounding said sheath; and (g) a magnet being located within the interior surface of said push button and being in adjacent relation with said sheath and armature, whereby when said push button is depressed, said magnet repels said armature to remove it out of blocking engagement with the passageway in said diaphragm, so that water within the valve chamber may pass through the open passageway to reduce the water pressure within the valve chamber, the resulting differential pressure applied across said diaphragm biasing it out of engagement with the valve stop to open said water valve, and allow passage of water from the inlet port to the outlet port, releasing said push button causing a reversal of the process to return said water valve to the closed position.

35. A portable lavatory facility as recited in claim 32, wherein said water valve remains open a predetermined time period after closure of said spring-biased flap valve to deliver a preset volume of water to the closed toilet bowl.

36. A portable lavatory facility as recited in claim 1, wherein said waste liquid source comprises a sink bowl operatively connected to said holding sump.

37. A portable lavatory facility as recited in claim 36, further comprising a water valve for conveying water to a faucet in response to an input condition.

38. A portable lavatory facility as recited in claim 37, wherein said input condition comprises a manually activated push button.

39. A portable lavatory facility as recited in claim 38, wherein said water valve comprises the water valve described in claim 34.

40. A portable lavatory facility as recited in claim 1, wherein said holding sump comprises a container having a volume of about 40 liters.

41. A portable lavatory facility as recited in claim 1, wherein said collection vessel comprises a container having a volume of about 2000 liters.

* * * * *

UNITED STATES PATENT AND TRADEMARK OFFICE

CERTIFICATE OF CORRECTION

PATENT NO. : 5,282,281

DATED : February 1, 1994

INVENTOR(S) : Christopher J. Clear, John M. Grooms, Blake V. Ricks

It is certified that error appears in the above-indentified patent and that said Letters Patent is hereby corrected as shown below:

Column 3, line 39, delete "n" and insert --in--;

Column 3, line 63, delete "2" and insert --24--;

Column 5, line 60, insert --a reinforced perimeter collar 65 to feature sides 65a and 65b-- after "from" and before "in";

Column 10, line 29, delete "s" and insert --so--;

Signed and Sealed this

Sixteenth Day of May, 1995

*Attest:*

*Attesting Officer*

BRUCE LEHMAN

*Commissioner of Patents and Trademarks*